United States Patent [19]

Sick et al.

[11] Patent Number: 4,492,259

[45] Date of Patent: Jan. 8, 1985

[54] APPARATUS FOR FILLING BOTTLES

[75] Inventors: Peter Sick, Ahlenbachweg 21a, D-7804 Glottertal, Fed. Rep. of Germany; Joseph Menini, Selencourt, France

[73] Assignee: Peter Sick, Glottertal, Fed. Rep. of Germany

[21] Appl. No.: 490,371

[22] Filed: May 2, 1983

[30] Foreign Application Priority Data

May 7, 1982 [DE] Fed. Rep. of Germany ..... 3217271

[51] Int. Cl.[3] ..... B65B 1/30

[52] U.S. Cl. ..... 141/198; 141/250; 141/275; 141/311 R; 141/291; 141/295; 141/360; 141/372

[58] Field of Search ..... 141/1, 5, 6, 7, 85, 141/86, 115, 126, 128, 192, 193, 198, 250, 251, 263, 267, 270, 275, 276, 291–296, 311, 351, 353, 360, 369, 372

[56] References Cited

U.S. PATENT DOCUMENTS

| | | | |
|---|---|---|---|
| Re. 28,275 | 12/1974 | Friendship | 141/6 |
| 2,660,350 | 11/1953 | Fechheimer | 141/126 |
| 2,779,358 | 1/1957 | Fechheimer et al. | 141/294 X |
| 3,056,436 | 10/1962 | Fechheimer et al. | 141/128 |
| 3,559,702 | 2/1971 | Riesenburg | 141/128 |
| 3,756,290 | 9/1973 | Cleland et al. | 141/5 |
| 3,797,535 | 3/1974 | Kaiser | 141/115 X |
| 3,845,791 | 11/1974 | Friendship | 141/6 |
| 3,871,425 | 3/1975 | Fee et al. | 141/5 |

*Primary Examiner*—Stephen Marcus
*Assistant Examiner*—Ernest G. Cusick
*Attorney, Agent, or Firm*—Lalos, Leeds, Keegan, Lett, Marsh, Bentzen, & Kaye

[57] ABSTRACT

Disclosed are a method and an apparatus for filling bottles with liquid to a predetermined fill height. A suction pipe is positioned relative to the bottle so that the pipe extends through the mouth of the bottle and the lower edge of the pipe is disposed at a fixed distance from the upper edge of the bottle and at a level slightly above the level of the predetermined fill height. Liquid is delivered by gravity into the bottle until the liquid level reaches the lower edge of the slightly elevated suction pipe. Then the suction pipe is lowered to the predetermined fill height and the supply of liquid is interrupted. The space above the liquid level in the bottle is connected with the outer atmosphere and excess liquid is drawn off by suction through the suction pipe until the liquid level in the bottle has dropped to the lower edge of the suction pipe.

10 Claims, 5 Drawing Figures

50
29
25b
30
28
31
32

13
14a
26
22
23
24
27
14
25
18a
24
25a
11
13a
18
13
10a
15
20
12

25a
26
16
30
19
21
16a
17
10b
33
34

APPARATUS FOR FILLING BOTTLES

BACKGROUND OF THE INVENTION

1. Field of the Invention

The present invention relates to a method and an apparatus for filling bottles with liquid to a predetermined fill height.

2. The Prior Art

Various types of automated devices for filling bottles are known wherein the fill height is measured from the bottom of the bottle. This has the drawback that when the heights of the bottles are not exactly the same, clearly visible differences result in the distance between the upper edges of the bottles and the liquid level. This creates the appearance that the bottles have differing liquid contents.

Another disadvantage common to the prior devices is that drops of liquid tend to adhere to the suction pipe after the same has been dipped into the liquid and then removed. This is undesirable for hygienic reasons. Finally, most of the prior art devices work relatively slowly so that synchronous operation in high-speed washing, filling and closing systems is difficult.

SUMMARY OF THE INVENTION

Therefore, an object of the present invention is to provide a method and apparatus for filling bottles wherein the filling height is fixed from the upper edge of the bottle and wherein an accurate, hygienic and rapid filling operation is facilitated. This is accomplished by the method and apparatus set forth in the claims.

In accordance with the present invention, the suction pipe is introduced into an empty or partially prefilled bottle to a level which corresponds to the desired filling height relative to the upper edge of the bottle. Thereupon, by slightly raising the suction pipe, a liquid valve is opened so that liquid flows into the bottle by gravitational forces, with excess air being discharged through the suction pipe. When the liquid level has reached the lower edge of the suction pipe or has slightly exceeded it, the suction pipe is again lowered to the original depth or immersion corresponding to the desired filling height and the liquid valve is closed at the same time. The space above the liquid level is subjected to atmospheric pressure, with the result that excess liquid is drawn off through the suction pipe until the liquid has dropped to a level immediately below the lower edge of the suction pipe. Subsequently, the connection between the vacuum source and the suction pipe is interrupted and inert gas is introduced into the space above the liquid level. The suction pipe is then removed from the bottle, and the bottle can be closed.

This procedure results in a distance between the upper edge of the bottle and the liquid level that can be accurately predetermined. The draw-off process further guarantees that the suction pipe will be completely dry after the filling is over, that is to say, drops of liquid do not tend to adhere to the pipe. The apparatus of the present invention is relatively simple and ensures fast operation that enables the use of the device within high-speed overall systems.

More specifically, the present invention provides a method of filling bottles with liquid to a predetermined fill height which comprises first causing a suction pipe that is connected to a vacuum source to be positioned relative to a bottle to be filled so that the pipe extends through the mouth of the bottle and with the lower edge thereof disposed slightly above the level of the predetermined fill height. Thereafter, liquid is delivered into the bottle until the liquid level reaches the lower edge of the pipe. Then the suction pipe is lowered until its lower edge is at the predetermined fill height and the filling operation is interrupted. Excess liquid is drawn from the bottle via the suction pipe until the liquid level has dropped to the predetermined fill height and then the space in the bottle above the liquid level is filled with an inert gas. In a more specific aspect of the invention, the suction pipe is lowered and the filling operation is interrupted at the same time.

The present invention also provides an apparatus for filling bottles with liquid to a predetermined fill height. This apparatus comprises a suction pipe adapted to be connected to a vacuum source and having a lower edge. Means are provided for supporting the pipe with its lower portion extending into a bottle to be filled and with said lower edge positioned slightly above the level of the predetermined height. The apparatus includes selectively operable valve means for opening to permit delivery of liquid into the bottle until the liquid level reaches the lower edge of the pipe and closing to interrupt the liquid delivery. Means are provided for lowering the suction pipe until its lower edge is at the predetermined fill height whereby when the pipe is connected to a vacuum source excess liquid is drawn from the bottle until the liquid level drops to the predetermined fill height. Finally, the apparatus includes means for delivering inert gas to the space in the bottle above the fill line. In a more specific aspect of the apparatus, the valve means and the suction pipe are interconnected whereby the valve means is closed when the suction pipe is lowered.

In an even more specific aspect, the apparatus for filling bottles with liquid to a predetermined height comprises a work station which includes an upper section and a lower section. The upper section includes a generally upstanding suction pipe, a liquid tank which is adapted for connection to a vacuum source and has an upper space in communication with said pipe, and a control assembly. The lower section includes a centering chuck having bottle top receiving and centering structure defining a central opening and the lower section is relatively upwardly and downwardly movable toward and away from the upper section between an initial bottle loading and unloading position and a bottle filling position proximal said upper section in response to the movement of a bottle to be filled toward and away from said filling position with its mouth in said structure in alignment with the opening. The suction pipe on the upper section is disposed in longitudinal alignment with the opening in the structure.

The control assembly includes a pipe segment disposed in surrounding relationship to the suction pipe to present an annular duct space therebetween, and atmospheric air and inert gas ducts are in fluid communication with the duct space. The duct space is in communication with the liquid tank and in alignment with the opening in the bottle top receiving and centering structure such that the duct space is in communication with the opening and the bottle mouth when the lower section and the bottle are in said bottle filling position. The pipe segment presents an annular valve seat at the upper end of the duct space and the suction pipe is longitudinally shiftable relative to said upper section and has an annular valve body mounted thereon in alignment with the valve seat whereby longitudinal shifting of the suction pipe opens and closes the valve to correspondingly cause and interrupt the communication between the space and the liquid tank. The upper and lower sections of the apparatus may include interengageable means for controlling the operation of the apparatus when the lower section is moved into its bottle filling position. The apparatus may have an operating rod connected to the suction pipe and extending in parallelism thereto and the interengageable means may be operable to move the rod and therefor the pipe longitudinally upwardly when the lower section is moved into its bottle filling position. Valve means may be provided for interrupting the communication between the suction pipe and the upper space of the tank and valve means may be included for selectively closing the atmospheric air and inert gas ducts. In a more specific aspect of the invention, the interengageable means may include a lifter element which is horizontally shiftable between a position where the lifter element is in vertical alignment with and disposed to engage the lower end of the operating rod and a position where the lifter is out of alignment with the operating rod.

BRIEF DESCRIPTION OF THE DRAWINGS

In the drawings:

FIGS. 2, 2A, 3, 3A, 4, and 4A are respective views similar to FIGS. 1 and 1A but illustrating the apparatus at other stages of the filling operation.

DETAILED DESCRIPTION OF A PREFERRED EMBODIMENT OF THE INVENTION

Figures 1, 1A:
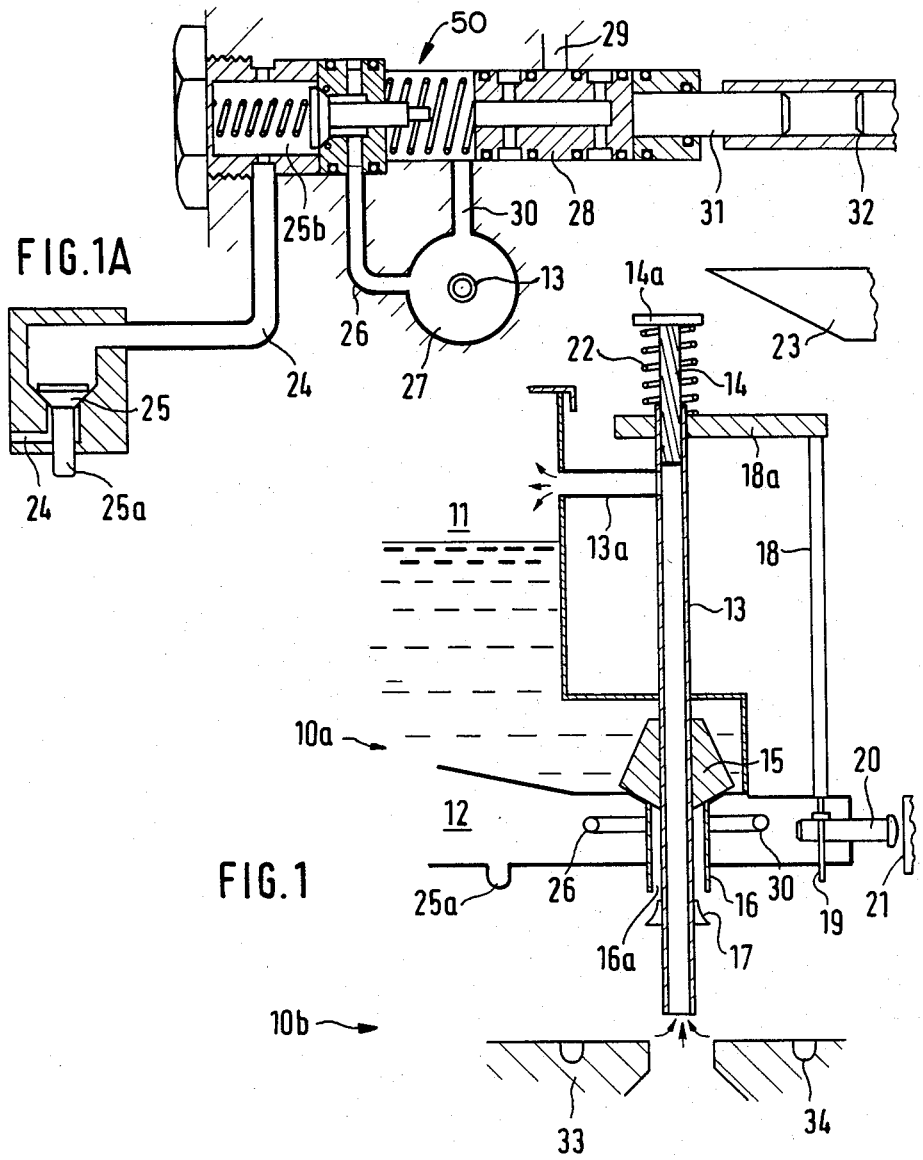
FIG. 1 is a vertical cross-sectional view of the apparatus of the present invention illustrating the relationship of the various elements with the lower section of its initial bottle loading and unloading position just prior to the beginning of the filling operation.
FIG. 1A is a schematic view of a portion of the control assembly of the apparatus of FIG. 1 and with the elements thereof in positions which correspond to the positions of the elements in FIG. 1.

As can be seen in FIG. 1, the apparatus of the present invention consists essentially of a work station comprising an upper section 10*a* and a lower section 10*b* which is upwardly and downwardly movable relative to section 10*a*. Section 10*a* includes a hermetically sealed liquid tank 11 and a control assembly 12 located below tank 11. A vertical suction pipe 13 projects through tank 11, through control assembly 12, and downwardly from assembly 12. Suction pipe 13 has an open lower end 13*b* and is closed at its upper end by a slide valve member 14 having an upper end piece 14*a*. Beneath slide valve 14, in the position thereof illustrated in FIG. 1, a horizontal pipe section 13*a* branches off from suction pipe 13. Pipe section 13*a* intercommunicates pipe 13 and the space above the liquid level in liquid tank 11. A pipe segment 16 is disposed in surrounding relationship to suction pipe 13 to present an annular duct space 16*a* therebetween. An annular valve body 15 is mounted on pipe 13 and is disposed within liquid tank 11. Valve body 15 cooperates with a valve seat 16*b* presented at the top of segment 16. Pipe segment 16 traverses the control assembly 12 coaxially to suction pipe 13 and protrudes slightly downwardly from control assembly 12 as can be seen. Finally, a dispersing ring 17 is fitted on suction pipe 13 just beneath segment 16.

An operating rod 18, disposed in parallelism with respect to pipe 13, has a lower end 18*b* which projects into control assembly 12. End 18*b* cooperates with a lifter element 19 mounted in a spring loaded, horizontally shiftable slide member 20 whereby element 19 is shiftable both vertically and horizontally. Slide member 20 is actuated for horizontal movement by pusher rod 21.

A horizontal connecting arm 18*a* rigidly interconnects the upper end of rod 18 and suction pipe 13 and helical spring 22 is positioned between connecting arm 18*a* and upper end piece 14*a* of slide valve 14 to bias the latter in an upward direction. A horizontally shiftable cam 23, with an inclined bearing face 23*a*, is positioned so that face 23*a* operatively engages end piece 14*a* to push valve 14 downwardly as cam 23 moves to the left.

The various control elements located in control assembly 12 are illustrated schematically in FIG. 1A. Flow of gas through an inert gas supply conduit 24 is controlled by a valve 25 which has a valve stem 25*a* that juts downwardly out of the control assembly as can be seen in FIG. 1. Downstream from valve 25, the inert gas conduit communicates with a cylinder housing 50 provided with a valve 27 having a valve lifter 27*a*. An inert-gas line 26 leads from cylinder housing 50 to the annular duct space 16*a* provided between pipe segment 16 and pipe 13. Housing 50 is also provided with an outside air duct 29 and an air line 30, the latter of which intercommunicates housing 50 and duct space 16*a*. A slide valve 28 is provided in housing 50 for controlling the communication between duct 29 and line 30. Slide valve 28 has a valve stem 31 which is positioned for contact by a push rod 32 to actuate valve 28.

Lower section 10*b* of the apparatus, which is movable toward and away from upper section 10*a*, consists of a centering chuck 33 having an annular groove 34 located on its upper surface. Chuck 33 includes a frusto-conical bottle receiving and centering structure 35 which presents an opening 35*a* through which a bottle is filled.

FIGS. 1 and 1A illustrate the initial bottle loading and unloading stage of the operating sequence of the apparatus, at a time before a bottle that is to be filled has arrived at the work station. Centering chuck 33 is initially spaced a short distance beneath control assembly 12, valve 25 is closed, and slide valve 28 closes line 30 to outside air and prevents the latter from entering annular duct space 16*a*. Tank 11 is connected to a vacuum source which maintains the space 11*a* above the liquid level at a slight subatmospheric pressure. At the same time, air is drawn through the open end 13*b* of suction pipe 13.

Figure 2:
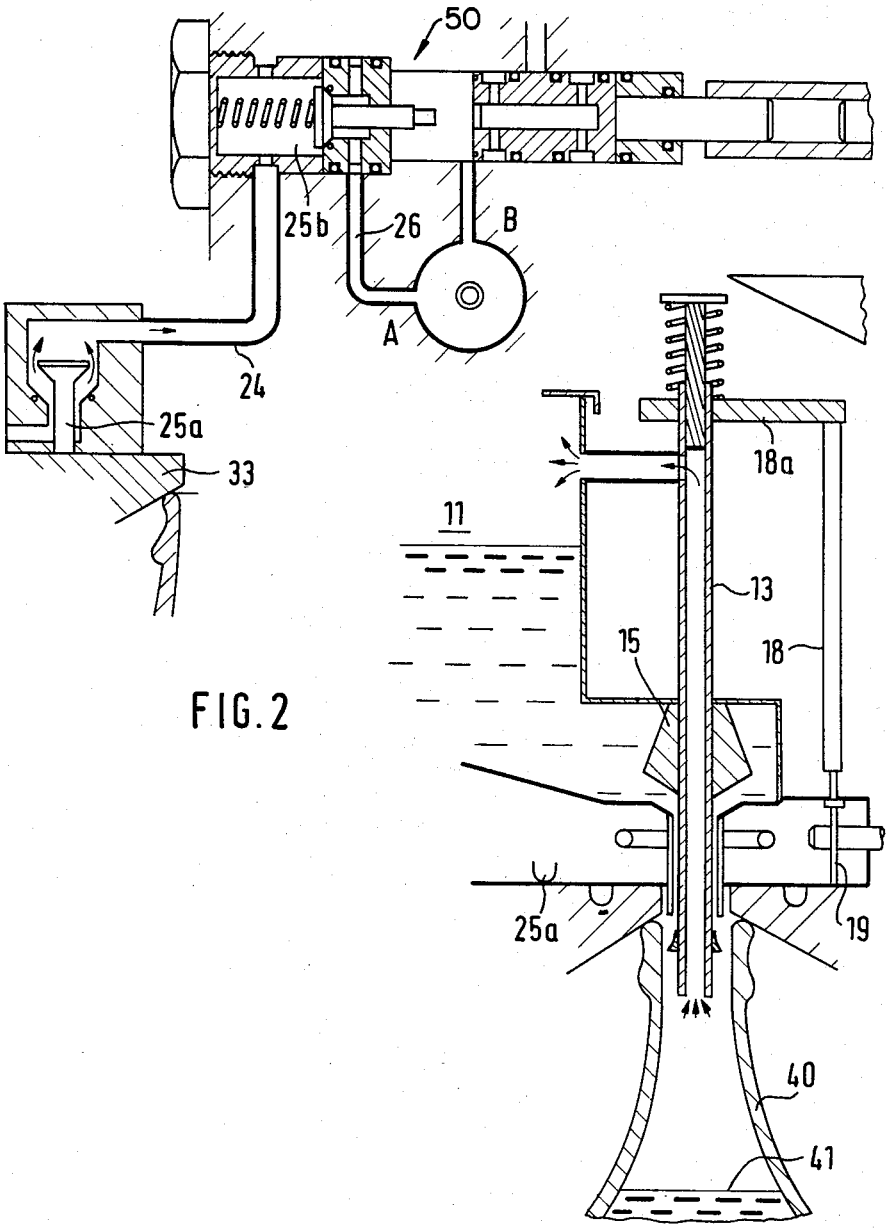

With reference to FIGS. 2 and 2A, when a bottle 40 that has been prefilled to a filling height 41 is delivered from the bottom and is lifted upwardly toward control assembly 12, the upper end 40*a* of the bottle contacts structure 35 and moves chuck 33 upwardly against the action of a spring and into contact with the lower surface of control assembly 12. As a result, stem 25*a* of valve 25 is lifted to open valve 25 and permit flow of inert gas through the line 24 and into the cylinder housing 50. The inert gas cannot flow into the line 26 because of the blocking action of valve 27. Chuck 33 also contacts and lifts lifter element 19 whereby rod 18, arm 18*a*, pipe 13, and valve body 15 are lifted. Thus, liquid flows from tank 11 through annular duct space 16*a* and downwardly into bottle 40. A dispensing ring 17 is provided to ensure that the liquid flows downwardly in bottle 40 along the inner surface of the bottleneck by gravitational force. Deaeration occurs by suction through pipe 13.

Figure 3:
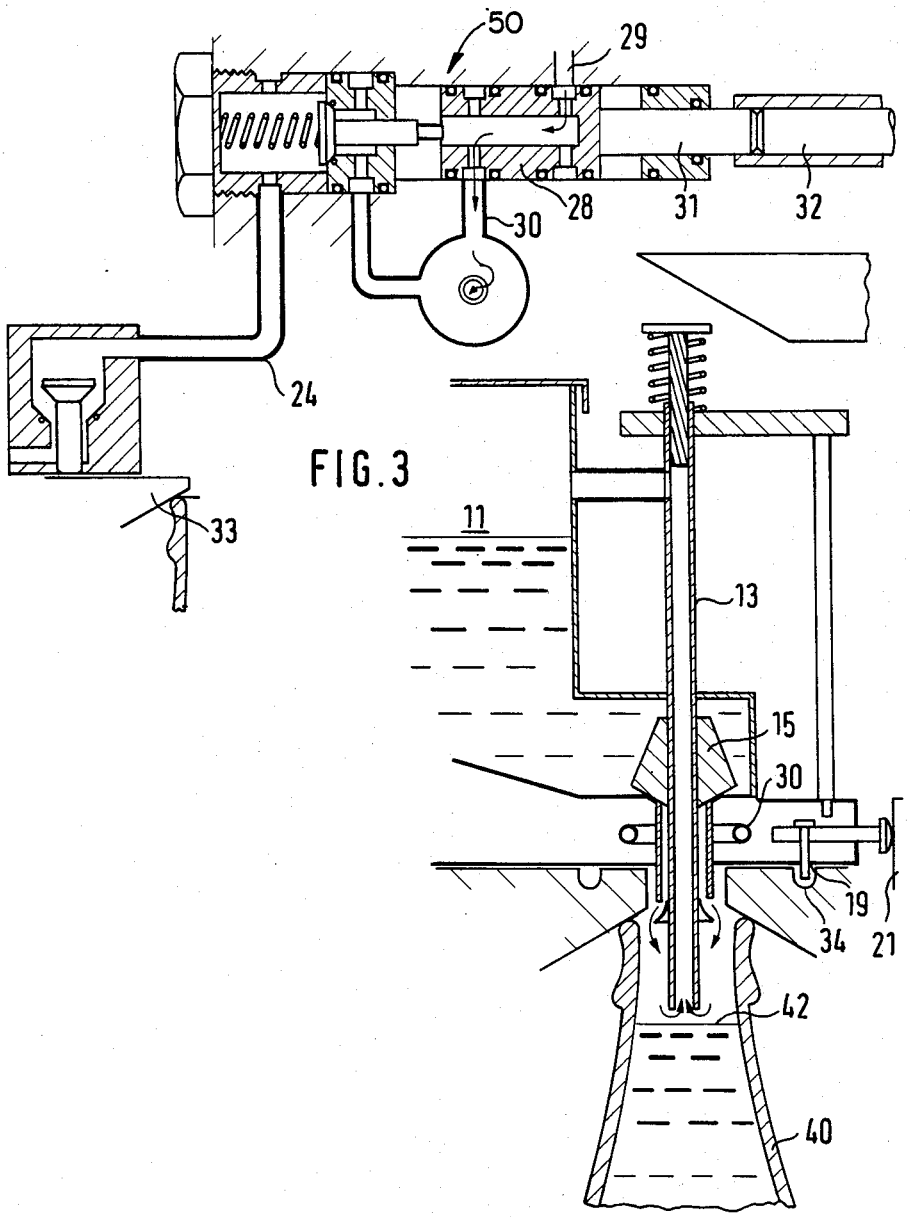

The next stage in the operation is illustrated in FIGS. 3 and 3A where it can be seen that when the liquid in bottle 40 has reached a level corresponding to the lower edge of suction pipe 13, or is slightly thereabove, pusher rod 21 comes into action to shift slide member 20 to the left against the action of a spring (not shown). Thus, lifter element 19 is moved to the left away from rod 18 and falls into the annular groove 34 of centering chuck 33. Rod 18, and therefor pipe 13, drops downwardly as a result and valve body 15 closes against seat **16*b* to prevent further flow of liquid from tank 11. At the same time, push rod 32 comes into action and moves to contact stem 31 and push slide valve 28 into a position where atmospheric air duct 29 is in communication with line 30 and thereby with annular duct space 16*a*. Thus, outside air flows through annular duct space 16*a* and into the interior of the bottle 40 above the fill level 42. However, the actual fill level 42 now is slightly above the lower edge 13*b* of the suction pipe 13 because the latter has dropped to close valve 15. As a result, liquid is drawn off upwardly through pipe 13 and flows into liquid tank 11 until the liquid level in bottle 40 has dropped to a height at or immediately beneath lower edge 13*b* of pipe 13. This process of upward suction of the liquid is supported by the presence of outside air in bottle 40** which exerts atmospheric pressure on the liquid.

Figure 4:
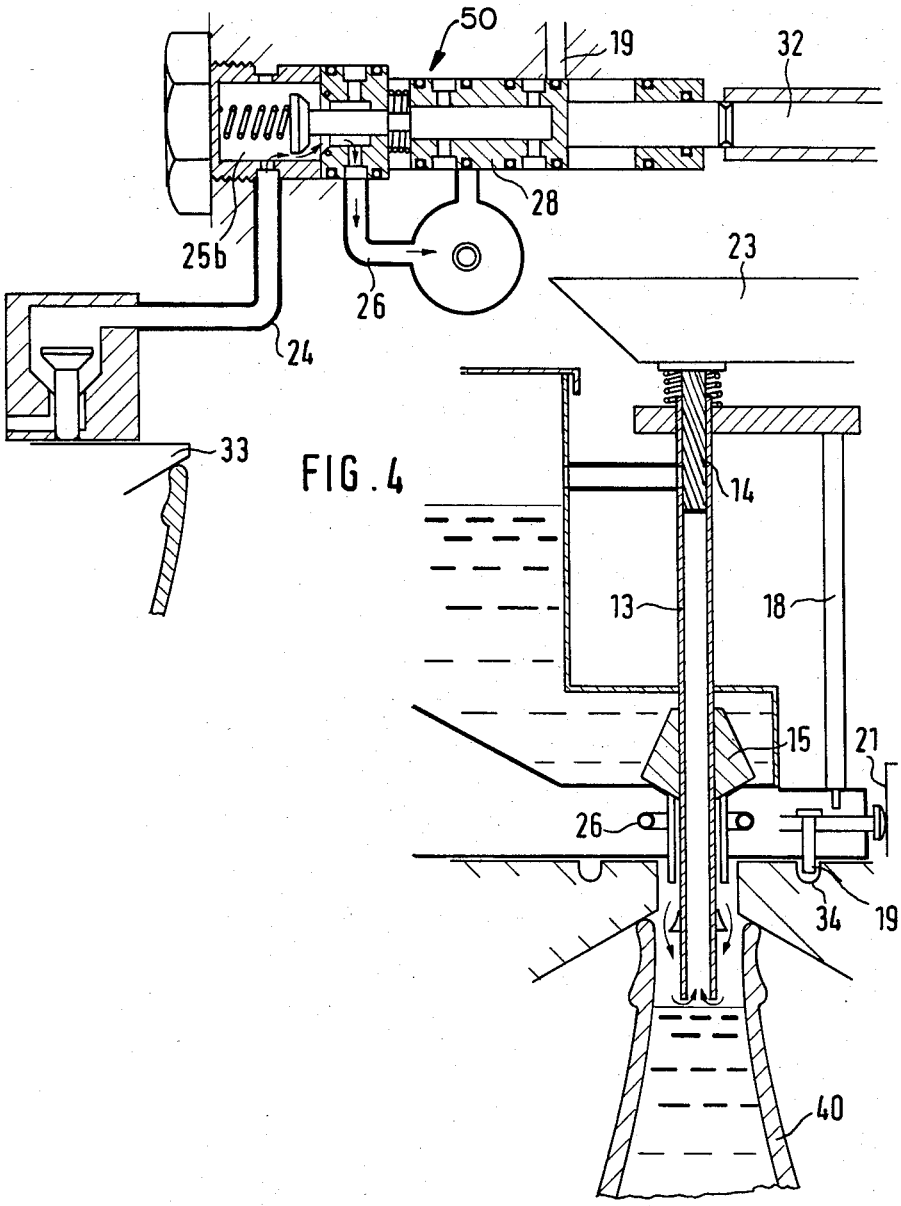

With reference now to FIGS. 4 and 4A, when the final fill level has been reached, push rod 32 comes into action for a second time to shift slide valve 28 further to the left to break the communication between air duct 29 and line 30. At the same time, slide valve 28 contacts valve lifter **27*a* and thereby pushes valve 27 into its open position. Thus, inert gas line 26 enters into fluid communication with inert-gas inlet conduit 24. This causes inert gas to flow through line 26, through annular duct space 16*a* and into the interior of bottle 40 above filling level 42. At the same time, cam 23 moves to the left to bring surface 23*a* into contact with piece 14*a* to press valve 14 downwardly and break the communication between pipe 13 and tank 11**.

With the filling process completed, bottle 40 is lowered and closed by means of an ordinary closure such as a cork or a crown cork. When bottle 40 is lowered, the chuck 33 moves downwardly with it and thus valve 25 is closed. Pusher rod 21, cam 23, and push rod 32 are also returned to their initial positions so that the initial unloading and loading stage illustrated in FIGS. 1 and 1A again prevails.

The essential advantage of the present invention resides in the fact that an extremely accurate filling level is achieved, whereby, and this is of great significance, the level is not fixed relative to the bottom of the bottle as heretofore, but relative to the upper edge **40*a* of the bottleneck. Also important is the fact that because of the suction present in pipe 13, air bubbles are prevented from forming during the filling. Finally, through the use of the present invention, once the filling is completed drops do not tend to adhere to the lower edge of the suction pipe 13**. This has been a great disadvantage in prior devices, at least from a hygienic point of view. Finally, the device is capable of high-speed operation, a factor which is of great importance if the apparatus is to be used in a commercial bottling operation.

The apparatus embodying the invention described above can be modified in numerous ways, especially with regard to the construction of the valves and the control elements. Also, the mechanical components may be adopted for operation in an electromechanical or electrically controlled manner. Furthermore, it is not necessary that suction pipe 13 be positioned exactly vertically and for some applications, an inclined position will be preferable.

Needless to say that containers other than bottles may be filled using the apparatus and method of the present invention.

We claim:

1. Apparatus for filling bottles with liquid to a predetermined height comprising:

a work station including an upper section and a lower section, said upper section including a generally upstanding suction pipe, a liquid tank adapted for connection to a vacuum source and having an upper space in communication with said pipe, and a control assembly, said lower section including a centering chuck having bottle top receiving and centering structure defining a central opening, said lower section being relatively upwardly and downwardly movable toward and away from said upper section between an initial bottle loading and unloading position and a bottle filling position proximal said upper section in response to the movement of a bottle to be filled toward and away from said filling position with its mouth in said structure and in alignment with said opening, said suction pipe on the upper section being disposed in longitudinal alignment with said opening in the structure, said control assembly including a pipe segment disposed in surrounding relationship to said suction pipe to present an annular duct space therebetween, and atmospheric air and inert gas ducts in fluid communication with said duct space, said duct space also being in communication with said liquid tank and disposed in alignment with said opening for communicating with the opening and the bottle mouth when the lower section is in its bottle filling position, said pipe segment presenting an annular valve seat at the upper end of said duct space, said suction pipe being longitudinally shiftable relative to said upper section and having an annular valve body mounted thereon in alignment with said valve seat, whereby longitudinal shifting of said suction pipe opens and closes said valve to correspondingly cause and interrupt the communication between the space and the liquid tank.

2. Apparatus as set forth in claim 1 wherein said upper and lower sections include interengageable means for controlling operation of the apparatus when the lower section is moved into its bottle filling position.

3. Apparatus as set forth in claim 2 wherein in provided an operating rod rigidly connected to said suction pipe and extending in parallelism thereto, said interengageable means being operable to move said rod and therefor said pipe longitudinally upwardly when said lower section is moved into its bottle filling position.

4. Apparatus as set forth in claims 1, 2, or 3 wherein said tank has an upper space and said upper section includes valve means for interrupting the communication between the suction pipe and said upper space of said tank.

5. Apparatus as set forth in claim 4 wherein said interengageable means includes a lifter element which is horizontally shiftable between a position where the lifter element is in vertical alignment with and disposed to engage the lower end of the operating rod and a position where the lifter is out of alignment with the operating rod.

6. Apparatus as set forth in claims 1, 2, or 5 wherein is included valve means for selectively closing said atmospheric air and inert gas ducts.

7. Apparatus as set forth in claim 6 wherein said interengageable means includes a lifter element which is horizontally shiftable between a position where the lifter element is in vertical alignment with and disposed to engage the lower end of the operating rod and a position where the lifter is out of alignment with the operating rod.

8. Apparatus as set forth in claim 3 wherein said interengageable means includes a lifter element which is horizontally shiftable between a position where the lifter element is in vertical alignment with and disposed to engage the lower end of the operating rod and a position where the lifter is out of alignment with the operating rod.

9. Apparatus as set forth in claim 4 wherein is included valve means for selectively closing said atmospheric air and inert gas ducts.

10. Apparatus as set forth in claim 9 wherein said interengageable means includes a lifter element which is horizontally shiftable between a position where the lifter element is in vertical alignment with and disposed to engage the lower end of the operating rod and a position where the lifter is out of alignment with the operating rod.

* * * * *